US006696951B2

(12) United States Patent
Belka et al.

(10) Patent No.: US 6,696,951 B2
(45) Date of Patent: Feb. 24, 2004

(54) FIELD CREATION IN A MAGNETIC ELECTRONIC ARTICLE SURVEILLANCE SYSTEM

(75) Inventors: Anthony Michael Belka, Stillwater, MN (US); Peter John Zarembo, Shoreview, MN (US); Edward David Goff, Mahtomedi, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 183 days.

(21) Appl. No.: 09/880,486

(22) Filed: Jun. 13, 2001

(65) Prior Publication Data

US 2002/0196144 A1 Dec. 26, 2002

(51) Int. Cl.[7] ..... G08B 13/14

(52) U.S. Cl. ..... 340/572.1; 340/572.3; 340/572.4; 340/572.6

(58) Field of Search ..... 340/572.1, 572.3, 340/572.4, 572.6

(56) References Cited

U.S. PATENT DOCUMENTS 5,341,125 A * 8/1994 Plonsky et al. ..... 340/572
5,625,339 A 4/1997 Zarembo et al.
5,781,111 A 7/1998 Easter et al.
5,805,065 A * 9/1998 Schwarz et al. ..... 340/572.1
5,844,485 A * 12/1998 Ryan, Jr. ..... 340/572
5,907,465 A 5/1999 Easter
5,926,095 A * 7/1999 Ho et al. ..... 340/572.6
6,002,335 A 12/1999 Zarembo et al.
6,057,763 A 5/2000 Brace et al.
6,169,483 B1 * 1/2001 Ghaffari et al. ..... 340/472.3
6,181,249 B1 1/2001 Maitin et al.
6,362,737 B1 * 3/2002 Rodgers et al. ..... 340/572.1

* cited by examiner

*Primary Examiner*—Jeffery Hofsass
*Assistant Examiner*—Hung Nguyen
(74) *Attorney, Agent, or Firm*—Melissa E. Buss

(57) ABSTRACT

In general, the invention is directed to techniques for creating and controlling a magnetic field for use with electronic article surveillance (EAS) markers. In particular, the techniques make use of current switching devices to generate a signal having one or more current pulses for creating the magnetic field. An electronic article surveillance (EAS) system includes a coil to create a magnetic field for changing a status of an EAS marker and a drive unit to output a signal having one or more current pulses for energizing the coil. A programmable processor within the EAS system controls the drive unit to generate the output signal according to a desired profile. By selectively activating and deactivating current switching devices within the drive unit, the processor can direct the drive unit to generate the output signal according to a desired profile having a number of current pulses of different amplitudes and direction.

16 Claims, 7 Drawing Sheets

FIELD CREATION IN A MAGNETIC ELECTRONIC ARTICLE SURVEILLANCE SYSTEM

TECHNICAL FIELD

The invention relates generally to security systems and, more particularly, to electronic surveillance systems.

BACKGROUND

Magnetic electronic article surveillance (EAS) systems are often used to prevent unauthorized removal of articles from a protected area, such as a library or retail store. A conventional EAS system usually includes an interrogation zone located near an exit of the protected area, markers or tags attached to the articles to be protected, and a device to sensitize (activate) or desensitize (deactivate) the markers or tags. Such EAS systems detect the presence of a sensitized marker within the interrogation zone and perform an appropriate security action, such as sounding an audible alarm or locking an exit gate. To allow authorized removal of articles from the protected area, authorized personnel desensitize the marker using the EAS system.

An EAS marker typically has a signal producing layer that, when interrogated by a proper magnetic field, emits a signal detectable by the EAS system. Markers of a "dual status" type, i.e., markers capable of being sensitized and desensitized, also have a signal blocking layer that can be selectively activated and deactivated. When the signal blocking layer is activated, it effectively prevents the signal producing layer from providing a signal that is detectable by an EAS detection system. Authorized personnel typically activate and deactivate a magnetic EAS marker by passing the marker near a magnetic field produced by the EAS system. The EAS system may include, for example, an array of magnets or an electric coil that produces a magnetic field of a desired intensity to change the state of the signal blocking layer of the marker. Many conventional EAS systems make use of a high voltage power supply and a tuned resistor-capacitor-inductor (RCL) circuit for controlling the magnetic field when sensitizing and desensitizing markers.

SUMMARY

In general, the invention is directed to techniques for creating and controlling a magnetic field for use with electronic article surveillance (EAS) markers. Unlike conventional systems that may incorporate an RCL circuit or other circuit for generating the magnetic field, the techniques make use of current switching devices to generate a signal having one or more current pulses for creating the magnetic field.

In one embodiment, the invention is directed to an electronic article surveillance (EAS) system having a coil to create a magnetic field for interacting with an electronic marker and a drive unit to output a signal having one or more current pulses for energizing the coil. A programmable processor within the EAS system controls the drive unit to generate the output signal according to a desired profile. To generate the output signal, the processor selectively activates electronic current switching devices within the drive unit.

By selectively activating and deactivating the current switching devices, the processor can direct the drive unit to generate the output signal according to a desired profile having a number of current pulses of different amplitudes and polarity. The drive unit may advantageously generate the output signal such that the rate of change of the current (di/dt) is substantially constant and, therefore, the current increases or decreases at substantially constant rates. Furthermore, the frequency of the pulses need not be fixed and can be readily controlled by the processor. These features have many advantages including improved marker detection over conventional systems in which the rate of change of the coil current typically follows a sinusoidal or other non-linear profile.

In addition, the programmable processor within the EAS system may dynamically adjust the current pulses of the output signal based on a number of factors including one or more configuration parameters set by a user, a type of article to which the marker is affixed, a sensed drive voltage and intensities of previously generated magnetic fields. In this manner, the EAS system is able to generate magnetic fields suitable for a variety of articles ranging from clothing to books to magnetically-recorded videotapes, and can compensate for effects of the surrounding environment or manufacturing variability.

In another embodiment, the invention is directed to a method including generating a signal having one or more current pulses by selectively activating and deactivating current switching devices, and driving the signal through a coil to generate a magnetic field for interacting with an electronic marker. The method may further include determining a profile for the current pulses of the signal, and selectively activating and deactivating the current switching devices according to the profile.

In another embodiment, the invention is directed to a computer-readable medium containing instructions. The instructions cause a programmable processor to calculate a target intensity for a magnetic field, and activate and deactivate a set of current switching devices to drive a pulse of current through a coil to create the magnetic field based on the target intensity.

The details of one or more embodiments of the invention are set forth in the accompanying drawings and the description below. Other features and advantages of the invention will be apparent from the description, the drawings, and the claims.

DETAILED DESCRIPTION

Figure 1:
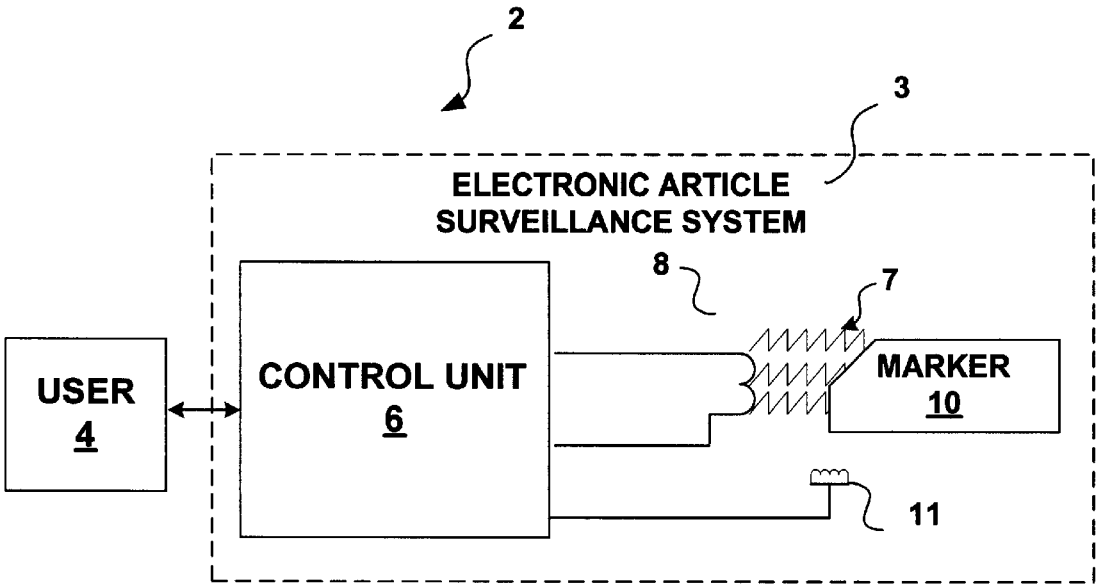
FIG. 1 is a block diagram illustrating an example embodiment of an electronic article surveillance (EAS) system configured according to the invention.

FIG. 1 is a block diagram illustrating a system 2 in which a user 4 interacts with an electronic article surveillance (EAS) system 3 to detect or change a state of, or otherwise interact with, an EAS marker 10. User 4 may, for example, sensitize or desensitize marker 10 when checking in or checking out, respectively, a protected article (not shown) to which marker 10 is affixed. Marker 10 maybe affixed to a variety of different articles such as books, videos, compact discs, clothing and the like.

EAS system 3 includes a control unit 6 that energizes coil 8 to create a magnetic field 7. Coil 8 may be any inductor capable of generating a magnetic field 7. Coil 8 may be, for example, a generally round, solenoid-type coil that provides a substantially uniform magnetic field 7 suitable to activate and deactivate marker 10. Other types of coils may also be used including non-solenoid-type coils or other devices that provide magnetic fields.

To create magnetic field 7, control unit 6 outputs a signal having one or more current pulses and drives the signal through coil 8 to energize coil 8 and produce magnetic field 7. Magnetic field 7, therefore, increases and decreases in intensity based on a "profile" of the pulsed output signal. Control unit 6 controls the intensity and orientation of magnetic field 7 by controlling an amplitude, duty cycle and polarity for each current pulse of the output signal. More specifically, control unit 6 determines a target intensity and orientation for magnetic field 7 and, based on the determined target intensity and orientation, controls a number of current pulses within the output signal, as well as an amplitude, duty cycle and polarity for each pulse. Control unit 6 may calculate the target intensity based on a number of factors. User 4 may, for example, set one or more configuration parameters within EAS system 3 to adjust the intensity. Control unit 6 may also adjust the target intensity based on a type of article to which the electronic marker 4 is affixed. Control unit 6 may, for example, calculate a lower target intensity for magnetically-recorded videotapes than for books or clothing. Control unit 6 may also incorporate an analog-to-digital converter (ADC) to sense a drive voltage and adjust the current pulses based on the sensed voltage.

In addition, EAS system 3 may incorporate feedback that enables control unit 6 to dynamically adjust the target intensity for magnetic field 7 based on a sensed intensity of magnetic field 7 or previously generated magnetic fields. More specifically, detector 11 senses an intensity of magnetic field 7 and provides control unit 6 a corresponding signal indicative of the sensed intensity. Based on the signal received from detector 11, control unit 6 may adjust the output signal to increase or decrease the intensity of magnetic field 7. In this manner, control unit 6 is able to compensate for effects on magnetic field 7 due to the surrounding environment or manufacturing variability.

Figure 2:
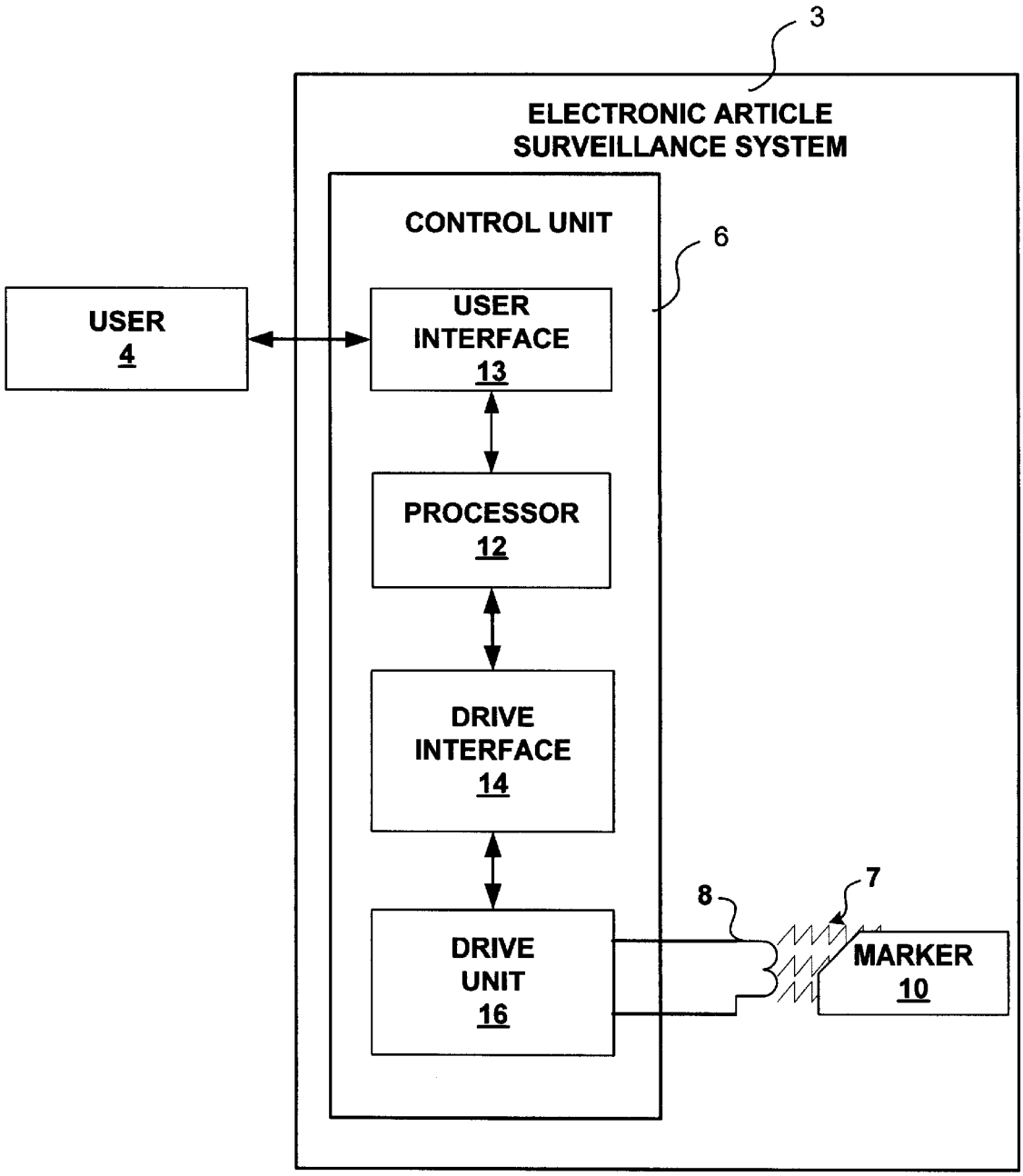
FIG. 2 is a block diagram further illustrating the example EAS system.

FIG. 2 is a block diagram illustrating the example EAS system 3 in further detail. In the illustrated embodiment, EAS system 3 includes user interface 13, processor 12, drive interface 14 and drive unit 16. User interface 13 includes hardware and software for interacting with user 4. User interface 13 may include, for example, a display or other output for presenting information to user 4, and a keyboard, keypad, mouse, trackball, custom panel or other suitable input device for receiving input. User interface 13 may also include one or more software modules executing in an operating environment provided by processor 12. The software modules may present a command line interface or a graphical user interface having a variety of menus or windows by which user 4 controls and configures EAS system 3.

EAS system 3 is not limited to a particular processor type. Processor 12 may be, for example, an embedded processor from a variety of manufacturers such as Intel Corporation, Cypress Corporation and Motorola Incorporated. Furthermore, Processor 12 may be a reduced instruction set computing (RISC) processor, a complex instruction set computing (CISC) processor, or variations of conventional RISC processors or CISC processors. In addition, the functionality carried out by Processor 12 may be implemented by dedicated hardware, such as one or more application specific integrated circuits (ASIC's) or other circuitry.

Control unit 6 may include a computer-readable memory (not shown) such as, for example, volatile and nonvolatile memory, or removable and non-removable media for storage of information such as instructions, data structures, program modules, or other data. The memory may comprise random access memory (RAM), read-only memory (ROM), EEPROM, flash memory, or any other medium that can be accessed by the Processor 12.

Processor 12 controls drive unit 16 to output a signal having one or more current pulses and drives the signal through coil 8 to energize coil 8 and produce magnetic field 7. In particular, drive unit 16 comprises a plurality of current switching devices for driving current pulses through coil 8. Drive unit 16 may comprise a number of N-Type MOSFET transistors for switching the current through coil 8.

In one embodiment, Processor 12 activates a first set of electronic current switching devices of drive unit 16 to drive the signal through coil 8 in a first direction, thereby creating magnetic field 7 in a first orientation. To create magnetic field 7 in an opposite orientation, processor 12 deactivates the first set of current switching devices and activates a second set of electronic current switching devices to drive the signal through the coil in the opposite direction. In this manner, control unit 6 can control the intensity and orientation of magnetic field 7 by selectively activating and deactivating the first and second set of current switching devices of drive unit 16 to generate the output signal having current pulses of calculated amplitudes and duty cycles.

Drive interface 14 includes circuitry for interfacing processor 12 with drive unit 16. Drive interface 14 may include, for example, programmable logic devices and one or more voltage comparators for providing control signals to drive unit 16 in response to signals received from processor 12.

Figure 3:
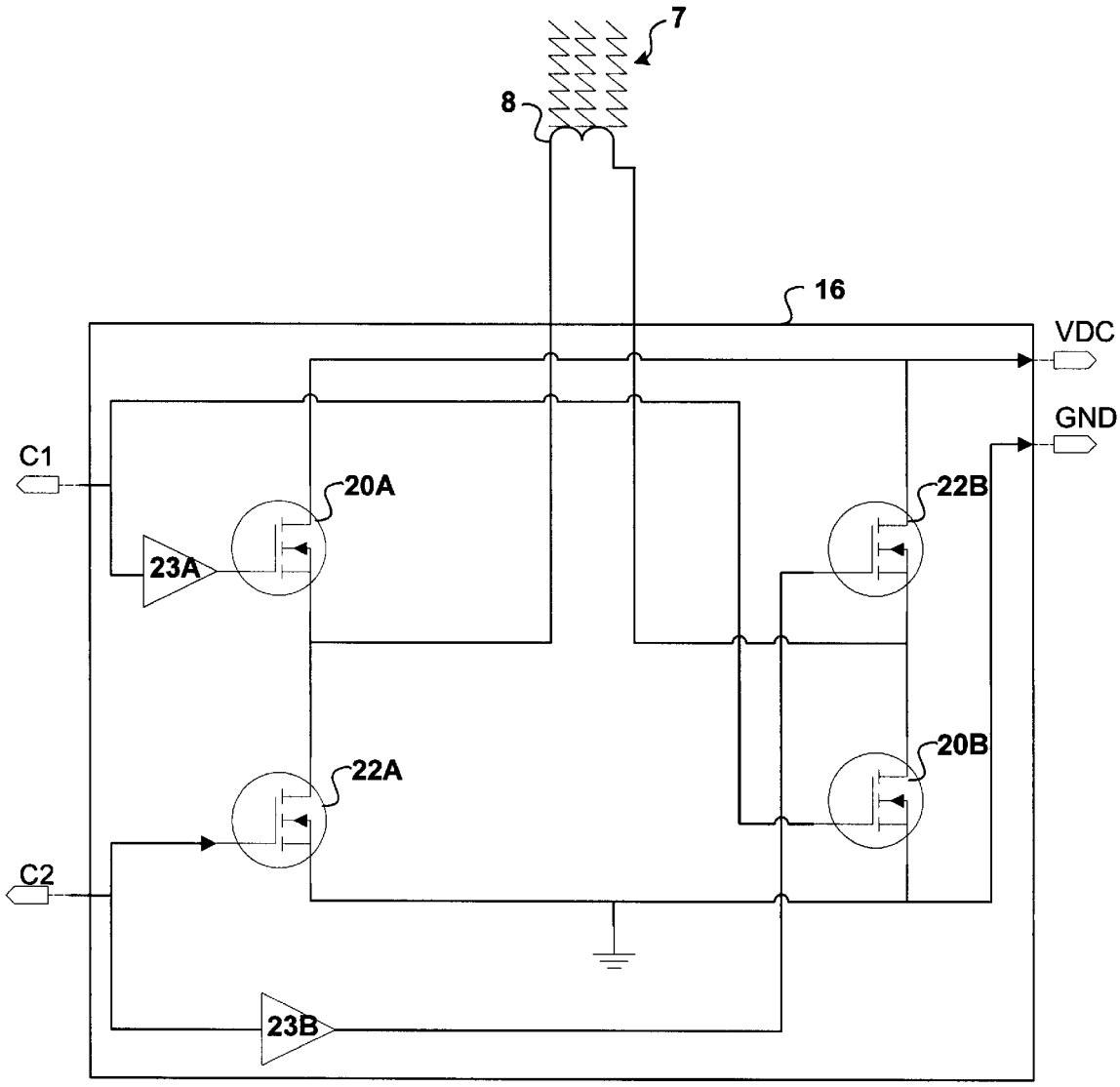
FIG. 3 is a schematic diagram illustrating an example embodiment of a drive unit of the EAS system.

FIG. 3 is a schematic diagram illustrating an example embodiment of drive unit 16 of EAS system 3. In this embodiment, drive unit 16 includes two sets of current switching devices 20 and 22 that processor 12 and drive interface 14 can selectively activate and deactivate using control lines C1 and C2, respectively. Based on control lines C1 and C2, voltage level shifters 23A and 23B apply suitable voltages to the corresponding gates of current switching devices 20 and 22. More specifically, processor 12 can direct drive interface 14 to enable control line C1 and thereby activate a first set of current switching devices 20A and 20B. In this mode, current flows from VDC through device 20A, through coil 8 in a first direction, and through device 20B to GND, thereby creating magnetic field 7. Upon deactivating devices 20A and 20B, energy is captured from magnetic field 7 and the current flow through coil 7 drops. Similarly, processor 12 can activate a second set of current switching devices 22A and 22B by enabling control line C2. In this mode, current flows from VDC through device 22B, through coil 8 in a second direction, and through device 22A to GND, thereby creating magnetic field 7 in an opposite orientation.

Thus, in this exemplary embodiment, processor 12 and drive interface 14 can alternatively enable control lines C1 or C2 for activation durations. In this manner, processor 12 can selectively activate and deactivate the first and second set of current switching devices 20 and 22 to direct drive unit 16 to output a signal having one or more current pulses. In response, coil 8 creates a magnetic field 7 having an intensity based on the amplitude of the current pulses and an orientation based on the direction in which the current flows through coil 8.

Figure 4A:
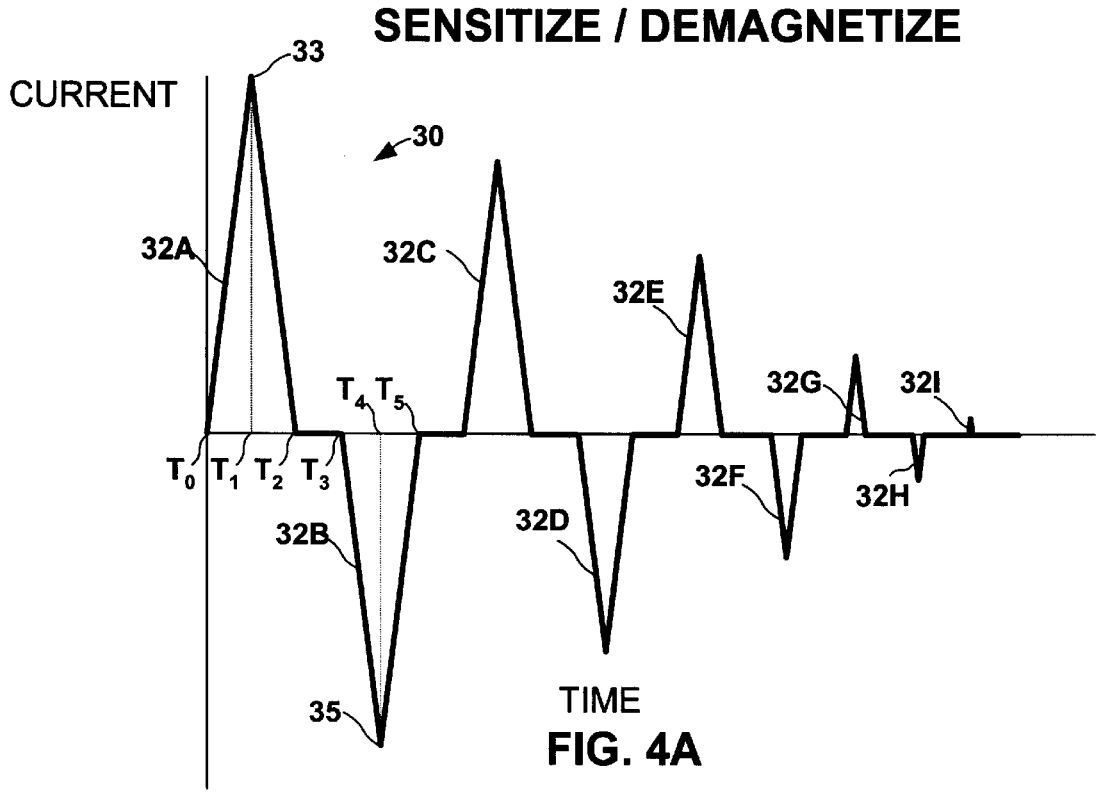
FIGS. 4A and 4B are graphs illustrating example output signals generated by the EAS system to produce magnetic fields.

FIG. 4A is a graph illustrating an example output signal 30 generated by drive unit 16 (FIG. 2) to sensitize (demagnetize) marker 10, thereby activating marker 10 for detection by EAS system 3. In particular, FIG. 4 plots the current of output signal 30 versus time. For exemplary purposes, reference is made to FIGS. 1–3.

To demagnetize marker 10, processor 12 selectively activates and deactivates the first and second set of current switching devices 20, 22 (FIG. 3) to generate the output signal 30 having a plurality of pulses 32A through 321, collectively referred to as pulses 32. Furthermore, by selectively activating and deactivating the current switching devices 20, 22 at calculated times, processor 12 can generate the output signal 30 to follow a desired profile. Signal 30 illustrates, for example, a decaying profile in which the amplitudes of the current pulses 32 decay over time. More specifically, processor 12 reduces the amplitudes of pulses 32 over time by shortening the corresponding duty cycle of each pulse, i.e., by activating and deactivating the corresponding current switching devices 20, 22 for shorter periods. In this manner, the time period from $T_3$ to $T_5$, for example, is shorter than the time period from $T_0$ to $T_2$. In one embodiment, processor 10 calculates a duty cycle of each subsequent pulse 32 that is 92% of the previous pulse.

To generate output signal 30, processor 12 activates the first set of current switching devices 20 at a time $T_0$, forming a first current pulse 32 within the output signal and causing current to flow through coil 8 (FIG. 3). At a time $T_1$, processor 12 deactivates the first set of current switching devices 20, causing current to drop from peak 33 until a time $T_2$ at which time current is no longer flowing through coil 8.

After generating current pulse 33, processor 12 activates the second set of current switching devices 22 at a time $T_3$, forming a second current pulse 35 and causing current to flow through coil 8 in an opposite direction from the current flow of pulse 33. At a point $T_4$, processor 12 deactivates the second set of current switching devices 20, causing current to drop from peak 35 until a time $T_5$ when current is no longer flowing through coil 8.

Notably, the increase and subsequent decrease of current flow of pulse 32 has a substantially constant rate of change. In other words, current flow increases and decreases in substantially linear fashion from $T_0$ to $T_1$ and from $T_1$ to $T_2$, respectively. Unlike conventional RCL circuits that follow a sinusoidal profile, drive unit 16 outputs a signal in which the rate of change of the current (di/dt) is substantially constant, according to the following equation:

$$V = L\frac{di}{dt} + iR,$$

in which iR is small compared to Ldi/dt. As a result, magnetic field 7 increases and decreases at constant rates in like manner. This has many advantages including improved marker detection.

In order to detect a sensitized marker 10, control unit 6 senses a signal emitted by marker 10 when marker 10 is exposed to magnetic field 7. The strength of the signal produced by marker 10 is a function of the location of marker 10 within magnetic field 7 and the rate of change of the current flowing through coil 8. Because the rate of change of the output signal produced by drive unit 16 is substantially constant, the strength of the signal does not vary as magnetic field 7 increases and decreases. Because control unit 6 need not compensate for signal variability due to changes in the slope of magnetic field 7 versus time, detecting the presence of marker 10 is simplified.

In addition, control unit 6 may determine whether marker 10 is sensitized or desensitized based on the harmonic content of the signal produced by marker 10. The harmonic content of a signal emitted by a marker, however, can be greatly affected by the rate of change of a surrounding magnetic field. Because the rate of change of the output signal produced by drive unit 16 is substantially constant, the harmonic content does not vary due to increases and decreases in magnetic field 7. As a result, control unit 6 can more readily detect markers and distinguish between sensitized and desensitized markers than conventional systems in which the rate of change follows a sinusoidal or other non-linear profile.

Figure 4B:
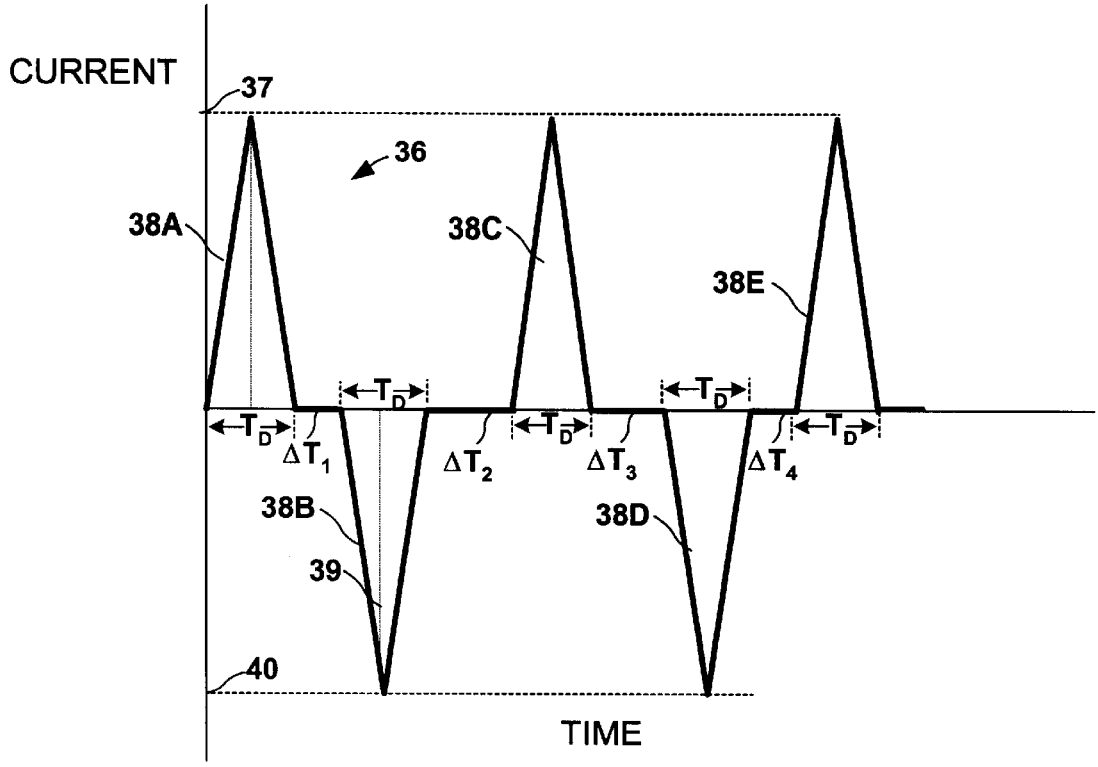

FIG. 4B is a graph illustrating another example output signal 36 generated by drive unit 16 (FIG. 2). Processor 12 selectively activates and deactivates the first and second set of current switching devices 20, 22 (FIG. 3) to generate the output signal 36 having a plurality of pulses 38A through 38E, collectively referred to as pulses 38. In particular, processor 12 generated pulses 38 to have substantially equal magnitudes 37, 40 and substantially equal durations $T_D$. Notably, processor 12 can control current switching devices 20, 22 to vary the time periods $\Delta T_1$, $\Delta T_2$, $\Delta T_3$, $\Delta T_4$, between subsequent pulses 38 to affect a total time for the output signal 36, and hence change the effective frequency of the output signal 36.

This embodiment can be particularly advantageous for avoiding ambient noise localized at particular frequencies. EAS system 3 may incorporate circuitry similar to drive unit 16 to produce, for example, an interrogation field having a high frequency, beneficial for interrogating EAS marker 10. In particular, the high frequency interrogation field may give rise to greater signal strength received from EAS marker 10 than magnetic field 7, which may be primarily used for sensitizing and desensitizing marker 10. In addition, control unit 6 can also change the effective frequency of the interrogation field by varying a DC supply voltage VDC (FIG. 3).

Figure 5:
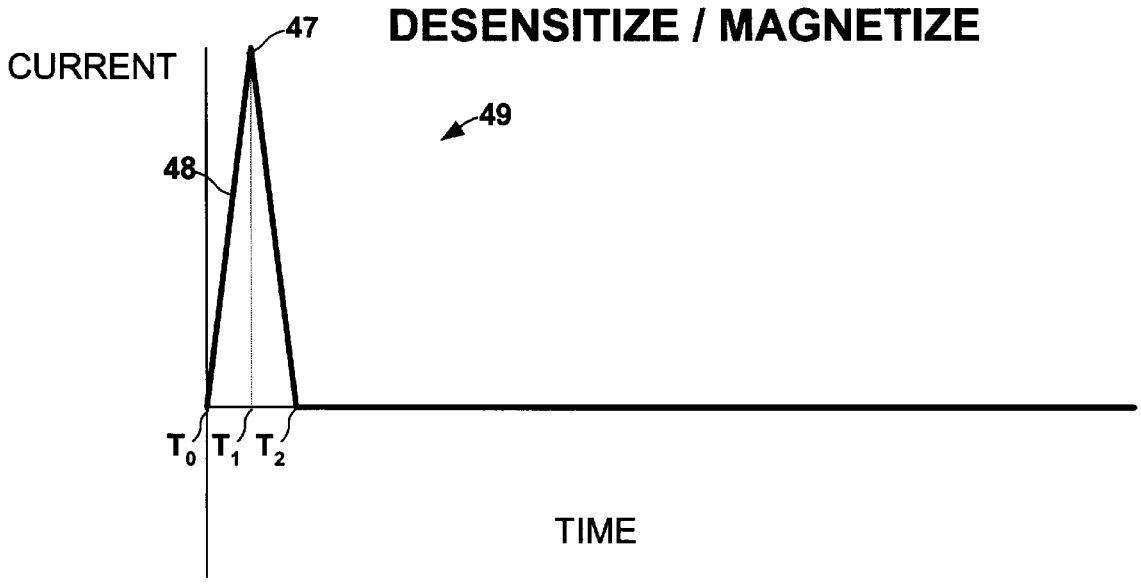
FIG. 5 is a graph illustrating an output signal generated by the EAS system to produce a magnetic field for desensitizing a marker.

FIG. 5 is a graph illustrating an example output signal 49 generated by drive unit 16 (FIG. 2) to desensitize (magnetize) marker 10, and thereby deactivate marker 10. To magnetize marker 10, processor 12 selectively activates and deactivates the first set of current switching devices 20 (FIG. 3) to generate the output signal 49 to have a single pulse 48. To generate output signal 49, processor 12 activates the first set of current switching devices 20 at a time $T_0$, forming a first current pulse 48 within the output signal 49 and causing current to flow through coil 8. At a point $T_1$, processor 12 deactivates the first set of current switching devices 20, causing current to drop from peak 47 until a point $T_2$ at which time current is no longer flowing through coil 8.

Figure 6:
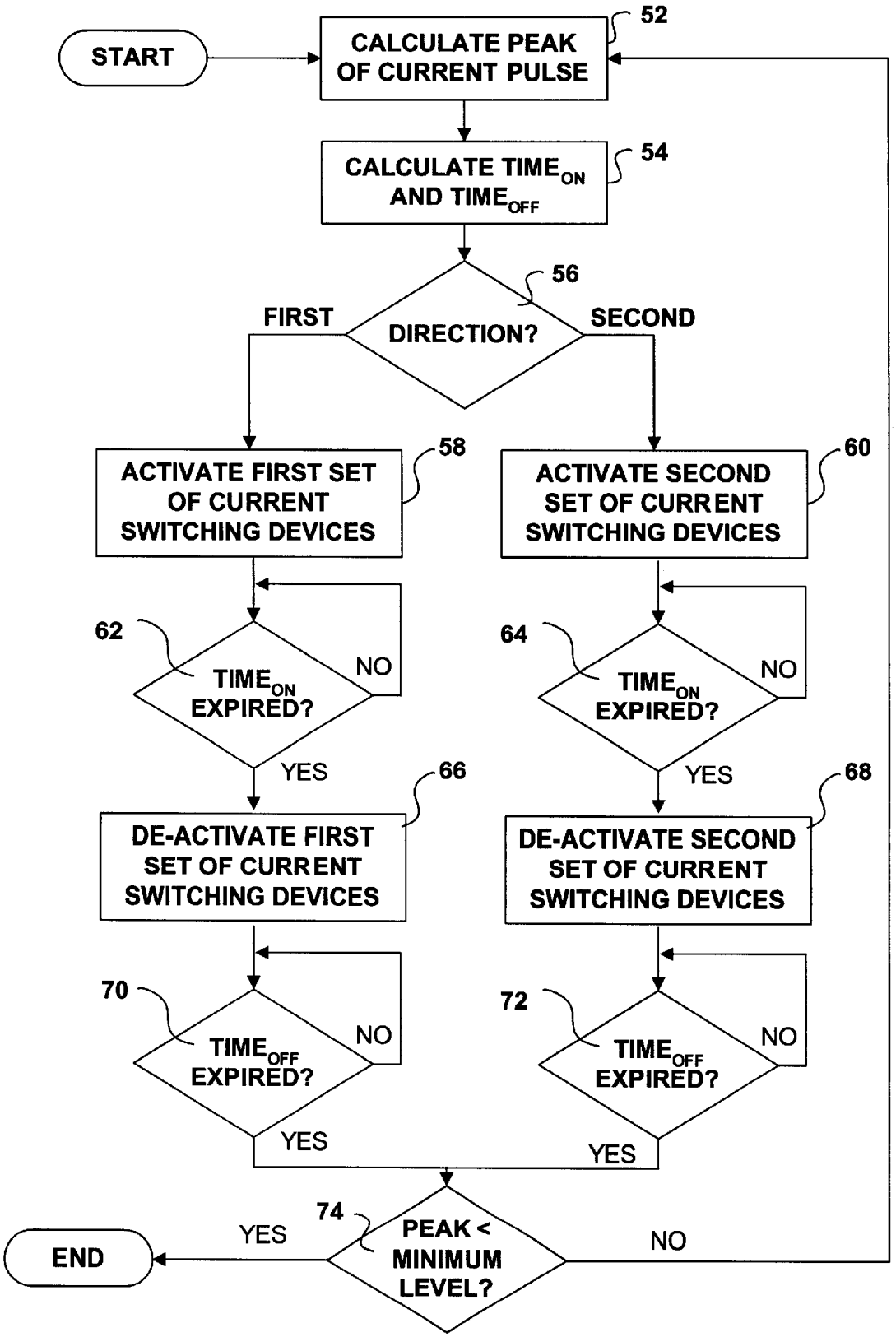
FIG. 6 is a flow chart illustrating an example mode of operation of the EAS system.

FIG. 6 is a flow chart illustrating an example mode of operation of the EAS system 3 when creating magnetic field 7. For exemplary purposes, reference is made to output signal 30 of FIG. 4.

Initially, processor 12 calculates a peak amplitude 33 for the first current pulse 32A based on a target intensity for magnetic field 7 (52). In determining the target peak amplitude, processor 12 may consider a number of factors including a measured drive voltage VDC, one or more configuration parameters set by user 4, a type article to which market 10 is affixed, and sensed intensities of previously generated magnetic fields, as described above. Typical configuration parameters that a user might set, for example, includes the type of media being processed, such as audio tapes, videotapes, books, compact discs, and the like, setting EAS system 3 in a check-in or check-out mode, setting EAS system 3 to verify the status of marker 10, and setting EAS system 3 in a non-processing mode to read radio frequency (RF) information from marker 10. In determining the target peak amplitude, processor 12 may, for example, read a radio frequency identification (RFID) tag fixed to an article or media in order to determine proper parameters for sensitizing or desensitizing the particular tag.

Based on the calculated peak, processor 12 determines an activation time $TIME_{ON}$ and a deactivation time $TIME_{OFF}$ for the current switching devices of drive unit 16 in order to generate a current pulse having the calculated peak (54). Next, processor 12 determines a direction for which current should flow through coil 8 according to the desired signal profile (56). Output signal 30 of FIG. 4, for example, has a profile in which a number of current pulses 32 alternate in polarity, yielding current flow in alternating directions.

Based on the directions, processor 12 selectively activates the first or second set of current switching devices 20, 22. More specifically, to drive current through coil 8 in a first direction, processor 12 activates the first set of current switching devices 20 by driving control line C1 high (58) until the activation $TIME_{ON}$ has elapsed (62). In current pulse 32A, for example, the activation time $TIME_{ON}$ equals $T_1$. Upon expiration of $TIME_{ON}$, processor 12 deactivates the first set of current switching devices 20 by driving control line C1 low (66) until the deactivation $TIME_{OFF}$ has elapsed (70). In current pulse 32A, for example, the deactivation time $TIME_{OFF}$ equals $T_3-T_1$.

After generating the pulse in the first polarity, processor 12 determines whether the target peak amplitude has dropped to a minimum level (74) and, if so, terminates the process. Current pulse 33I, for example, has an amplitude below a defined minimum level, causing Processor 12 to stop generating the series of pulses 32.

If, however, the target amplitude has not yet reached the minimum level, processor 14 repeats the process by calculating a new target amplitude (52) and a corresponding activation time $TIME_{ON}$ and a deactivation time $TIME_{OFF}$ (54). In this iteration, Processor 12 may elect to drive current through coil 8 in a second direction (56) by driving control line C2 high to activate the second set of current switching devices 22 (60) until the activation $TIME_{ON}$ has elapsed (64). In current pulse 32B, for example, the activation time $TIME_{ON}$ equals $T_4-T_3$. Upon expiration of $TIME_{ON}$, processor 12 deactivates the second set of current switching devices 22 by driving control line C1 low (68) until the deactivation $TIME_{OFF}$ has elapsed (72). In this manner, processor 12 may repeat the process to generate an output signal having one or more current pulses according to a desired profile.

The above-describe process is for exemplary purposes, and may be readily modified by EAS system 3. For example, processor 14 may repetitively interrogate the marker and generate magnetic fields of higher intensities until a signal received from the marker indicates that the measured residual value of the marker meets an acceptable level. When sensitizing the marker, processor 12 may control drive circuit 16 to subject the marker to a series of magnetic fields of higher and higher intensities until the residual value for the marker drops and reaches a specified minimum level. Similarly, when desensitizing a marker, processor 12 may control drive circuit 16 to subject the marker to a series of magnetic fields having higher and higher magnetic intensities until the residual value for the marker reaches to a specified maximum level.

In this manner, with the ability to interrogate the marker and the ability to control the magnetic field, EAS system 3 can ensure that the marker is subjected to the minimum field necessary to obtain the desired result. Processor 12 may terminate the process when the targeted level has been reached or when a maximum limit on field intensity has been achieved.

The ability to finely control the magnetic field offers many advantages, including enhanced detection capabilities if all markers are brought to approximately the same level of residual value. Furthermore, such features may be advantageous in markets with heavy regulations regarding magnetic fields.

Figure 7:
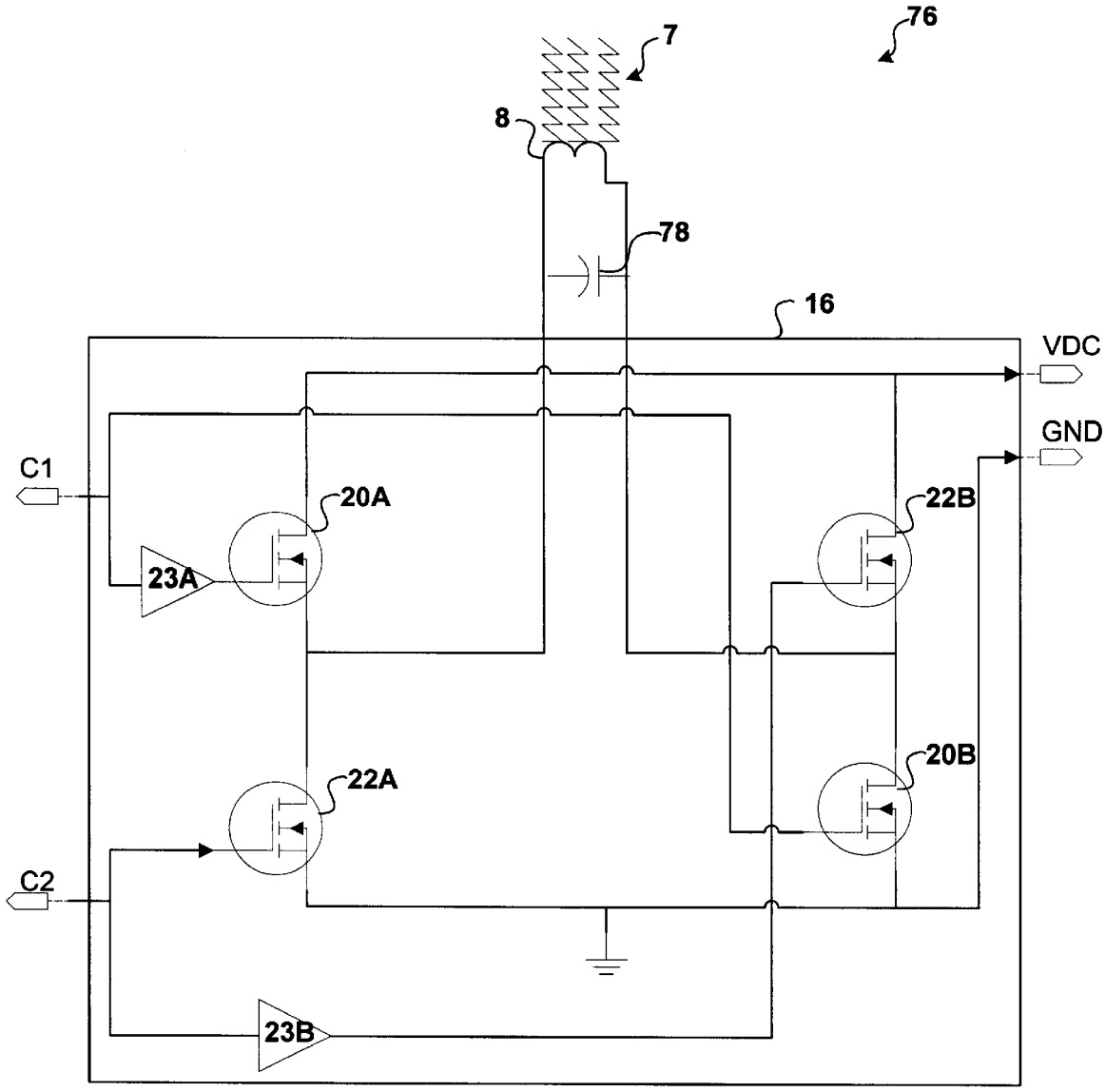
FIG. 7 is a schematic diagram illustrating another example embodiment of a drive unit.

FIG. 7 is a schematic diagram illustrating another example embodiment of a drive unit 76 that includes capacitor 78 in parallel with coil 8. In this embodiment, drive unit 76 may provide an output signal having one or more current pulses to charge capacitor 78, causing magnetic field 7 to resonate at very high frequencies. In this manner, drive unit 76 may be useful in generating magnetic fields for verifying a change of state of an EAS marker and, therefore, detecting whether an EAS marker is present.

Various embodiments of the invention have been described. These and other embodiments are within the scope of the following claims.

What is claimed is:

1. A computer-readable medium comprising instructions to cause a processor to:

calculate a first target intensity for a first magnetic field;

activate and deactivate a first set of current switching devices in accordance with a first programmable activation duration and a first programmable polarity to drive a first pulse of current through a coil to create the first magnetic field having the first target intensity, wherein the first pulse has a first duration and a first polarity that conforms to the first programmable activation duration and the first programmable polarity;

calculate a second target intensity for a second magnetic field; and activate and deactivate a second set of current switching devices in accordance with a second programmable activation duration and a second programmable polarity to drive a second pulse of current through the coil to create the second magnetic field having the second target intensity and an orientation different from the first magnetic field, wherein the second pulse has a second duration and a second polarity that conforms to the second programmable activation duration and the second programmable polarity.

2. The computer-readable medium of claim 1, further comprising instructions to cause the processor to:

sequentially repeat the activating and deactivating of the first and second set of current switching devices to produce the first pulse and the second pulse as a series of current pulses, wherein the series of current pulses have amplitudes that follow a decay profile; and terminate the series of current pulses when the amplitudes have decayed to a minimum level.

3. The computer-readable medium of claim 1, further comprising instructions to cause the processor to detect an actual intensity of the first magnetic field and generate subsequent pulses based on the detected actual intensity.

4. The computer-readable medium of claim 3, further comprising instructions to cause the processor to calculate the first target intensity based on at least one of configuration parameters, a type of item to which an electronic marker is affixed, a sensed drive voltage, and sensed actual intensities of previously generated magnetic fields.

5. The computer-readable medium of claim 3, further comprising instructions to cause the processor to control amplitudes of the first and second current pulses based on the detected actual intensity.

6. The computer-readable medium of claim 1, further comprising instructions to cause the processor to:

calculate a target peak amplitude for the first pulse based on the first programmable activation duration; and activate the first set of current switching devices to achieve the target peak amplitude.

7. The computer-readable medium of claim 6, further comprising instructions to cause the processor to:

calculate a target peak amplitude for the second pulse as a function of the target peak amplitude for the first pulse; and activate the second set of current switching devices to achieve the calculated target peak amplitude for the second pulse.

8. The computer-readable medium of claim 1, further comprising instructions to cause the processor to control a drive unit that drives the first and second pulses through the coil.

9. The computer-readable medium of claim 8, wherein the instructions cause the processor to control the drive unit by sequentially placing the drive unit in a first state to energize the coil and a second state to de-energize the coil.

10. The computer-readable medium of claim 1, further comprising instructions to cause the processor to sequentially repeat the activating and deactivating of the first and second set of current switching devices to produce the first pulse and the second pulse as a series of current pulses.

11. The computer-readable medium of claim 10, wherein the series of current pulses cause a current through the coil to increase and decrease at substantially constant rates.

12. The computer-readable medium of claim 10, further comprising instructions to cause the processor to determine a decay profile for the series of current pulses and to activate and deactivate the first and second set of current switching devices according to the decay profile.

13. The computer-readable medium of claim 10, further comprising instructions to cause the processor to activate and deactivate of the first and second set of current switching devices to produce the series of current pulses to have decreasing duty cycles.

14. The computer-readable medium of claim 13, further comprising instruction to cause the processor to decrease each subsequent duty cycle by a constant percentage of a preceding one of the duty cycles.

15. The computer-readable medium of claim 13, further comprising instructions to cause the processor to decrease each subsequent duty cycle by a varied amount.

16. The computer-readable medium of claim 13, further comprising instructions to cause the processor to decrease each subsequent duty cycle by approximately 92% of a preceding duty cycle.

* * * * *

UNITED STATES PATENT AND TRADEMARK OFFICE

CERTIFICATE OF CORRECTION

PATENT NO. : 6,696,951 B2
DATED : February 24, 2004
INVENTOR(S) : Belka, Anthony M.

It is certified that error appears in the above-identified patent and that said Letters Patent is hereby corrected as shown below:

Column 3,
Line 5, delete “maybe” and insert -- may be --.

Column 5,
Line 18, delete “321” and insert -- 32I --

Signed and Sealed this

Thirteenth Day of July, 2004

JON W. DUDAS
*Acting Director of the United States Patent and Trademark Office*